US007806238B2

(12) United States Patent
Fischer

(10) Patent No.: US 7,806,238 B2
(45) Date of Patent: Oct. 5, 2010

(54) ELEVATOR AND PULLEY ASSEMBLY FOR USE IN AN ELEVATOR

(75) Inventor: Daniel Fischer, Villarsel sur Marly (CH)

(73) Assignee: Inventio AG, Hergiswil NW (CH)

( * ) Notice: Subject to any disclaimer, the term of this patent is extended or adjusted under 35 U.S.C. 154(b) by 349 days.

(21) Appl. No.: 11/571,959

(22) PCT Filed: Jul. 12, 2005

(86) PCT No.: PCT/CH2005/000397

§ 371 (c)(1),
(2), (4) Date: Oct. 25, 2007

(87) PCT Pub. No.: WO2006/005215

PCT Pub. Date: Jan. 19, 2006

(65) Prior Publication Data

US 2008/0121468 A1 May 29, 2008

(30) Foreign Application Priority Data

Jul. 12, 2004 (EP) ..... 04016324

(51) Int. Cl.
*B66B 11/08* (2006.01)
*B66B 11/04* (2006.01)

(52) U.S. Cl. ..... 187/266; 187/251

(58) Field of Classification Search ..... 187/251, 187/256, 266; 254/266, 283
See application file for complete search history.

(56) References Cited

U.S. PATENT DOCUMENTS

| | | | | |
|---|---|---|---|---|
| 1,029,627 | A | 6/1912 | Pearson | |
| 5,351,788 | A * | 10/1994 | DeJong | 187/264 |
| 6,397,974 | B1 * | 6/2002 | Adifon et al. | 187/254 |
| 6,401,871 | B2 * | 6/2002 | Baranda et al. | 187/254 |
| 6,471,012 | B2 * | 10/2002 | Faletto | 187/256 |
| 2004/0108170 | A1 * | 6/2004 | Kocher et al. | 187/254 |
| 2005/0217943 | A1 * | 10/2005 | Heggli et al. | 187/266 |
| 2008/0314691 | A1 * | 12/2008 | Mustalahti et al. | 187/254 |

FOREIGN PATENT DOCUMENTS

| | | | |
|---|---|---|---|
| EP | 0588364 | A1 | 3/1994 |
| EP | 1396458 | A2 * | 3/2004 |
| WO | WO 99/43593 | A1 | 9/1999 |

* cited by examiner

*Primary Examiner*—John Q Nguyen
*Assistant Examiner*—Stefan Kruer
(74) *Attorney, Agent, or Firm*—Fraser Clemens Martin & Miller LLC; William J. Clemens

(57) ABSTRACT

An elevator comprises an elevator car and support belts that form a 4:1 suspension for the elevator cabin and that are looped several times beneath the elevator car. Several parallel, flat belts are used and the rollers of at least one fixed roller group that diverts the belts are positioned in such a way that the belt sections of the parallel belts lie vertically above one another in the vicinity of the belt diversion.

12 Claims, 6 Drawing Sheets

ELEVATOR AND PULLEY ASSEMBLY FOR USE IN AN ELEVATOR

BACKGROUND OF THE INVENTION

The present invention relates to an elevator and a roller arrangement for use in an elevator. The invention is particularly, but not exclusively, suitable for use in conjunction with an elevator system without an engine room.

Use is made, particularly for elevators which are designed for moving larger loads, of a so-termed 4:1 suspension in which the region, which is driven by the drive pulley, of the supporting and/or driving element moves four times faster than the elevator car. Such a suspension is schematically shown in European patent EP 588 364.

Space problems arise in 4:1 suspensions of that kind, but also in other arrangements, particularly when the elevator system does not have an engine room. The more elevator components have to be accommodated in the shaft, the more important it is to find a space-saving approach.

SUMMARY OF THE INVENTION

It is now an object of the present invention to propose an improved elevator of the kind stated in the introduction, which can be accommodated in very space-saving manner in a shaft.

The use of several flat belts, which are arranged parallel to one another, as supporting and driving means enables use of a drive pulley as well as supporting and deflecting rollers with small diameters. A small drive pulley diameter enables use of drive motors or drive units with small dimensions, and with small supporting and deflecting rollers optimum use can be made of the available installation space. It is achieved by the elevator or roller arrangement according to the invention that the installation space required laterally adjacent to the elevator car for the deflection of several parallel belts can be kept as small as possible and simple roller frames of small construction can be used. Moreover, the invention makes it possible to arrange the deflecting rollers, which are present in the region of the under-looping on respective sides of the elevator car, along a common axis.

In an economic form of embodiment at least one of the fixed roller groups has a single associated roller for each of the belts arranged in parallel, wherein each belt loops around the associated roller by more than 90°.

Advantageously, in the case of the form of embodiment described in the foregoing the rollers of the associated movable (car) roller group are arranged along axes which are disposed at an inclination or are self-setting in correspondence with the direction of the upwardly leading belt sections.

In a preferred form of embodiment of the present invention at least one fixed roller group deflecting the belts has two associated rollers for each of the belts arranged in parallel.

According to particularly preferred form of embodiment at least one fixed roller group has two subgroups of rollers, wherein the rollers of these subgroups deflect the belts, which are arranged in parallel, in each instance by a part of the total deflection angle. The rollers of each of the subgroups are arranged slanted one above the other and have a horizontal axial spacing between two adjacent rollers, the spacing preferably being greater than the width of the belt. It is achieved by this form of embodiment that the longitudinal axes of the belt sections arranged between the fixed and movable car roller groups remain vertically aligned in every position of the elevator car.

Advantageously, the rollers of the fixed (multi-axial) roller groups lie within two parallel planes spaced by the roller width, wherein the axes of the rollers are oriented at right angles to these planes. Installation space required for the roller group is thus minimized.

Advantageous conditions with respect to fastening and maintenance of the fixed roller groups result when these are arranged laterally of and/or above the elevator car and are preferably fastened to or on one or more of the guide rails of the elevator car.

Advantages for setting and retightening of the belts result from the fixing points of all belts being arranged directly adjacent to and/or on a fixing point support. Through connection of the fixing point support with one of the guide rails it is possible to avoid the need for the loading of the support by the belt forces to be absorbed exclusively by the shaft wall of the elevator installation.

According to a further preferred form of embodiment the belts are provided at at least one of the main surfaces thereof with ribs and grooves extending in belt longitudinal direction, and the drive pulley as well as the supporting and deflecting rollers have corresponding complementary ribs and grooves along the circumference of their running surfaces. The guidance characteristics between the rollers and the belt as well as the traction capability between drive pulley and belt can be substantially improved by this measure.

The present invention relates to an elevator with several flat belts, which are arranged parallel to one another, as support means. By the term "several belts" there is to be understood at least two and at most eight belts. By the term "belts arranged in parallel" there is to be understood in that case not a geometrically precise parallel arrangement, but a substantially parallel arrangement of several functionally equivalent belts. By the term "flat belts" there is to be understood belts with substantially rectangular cross-section, the width of which is greater than the height (thickness) thereof. Coming within this term are, in particular, also belts which have a profiled running surface, for example wedge ribs extending in longitudinal direction of the belt.

DESCRIPTION OF THE DRAWINGS

The above, as well as other, advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1A:
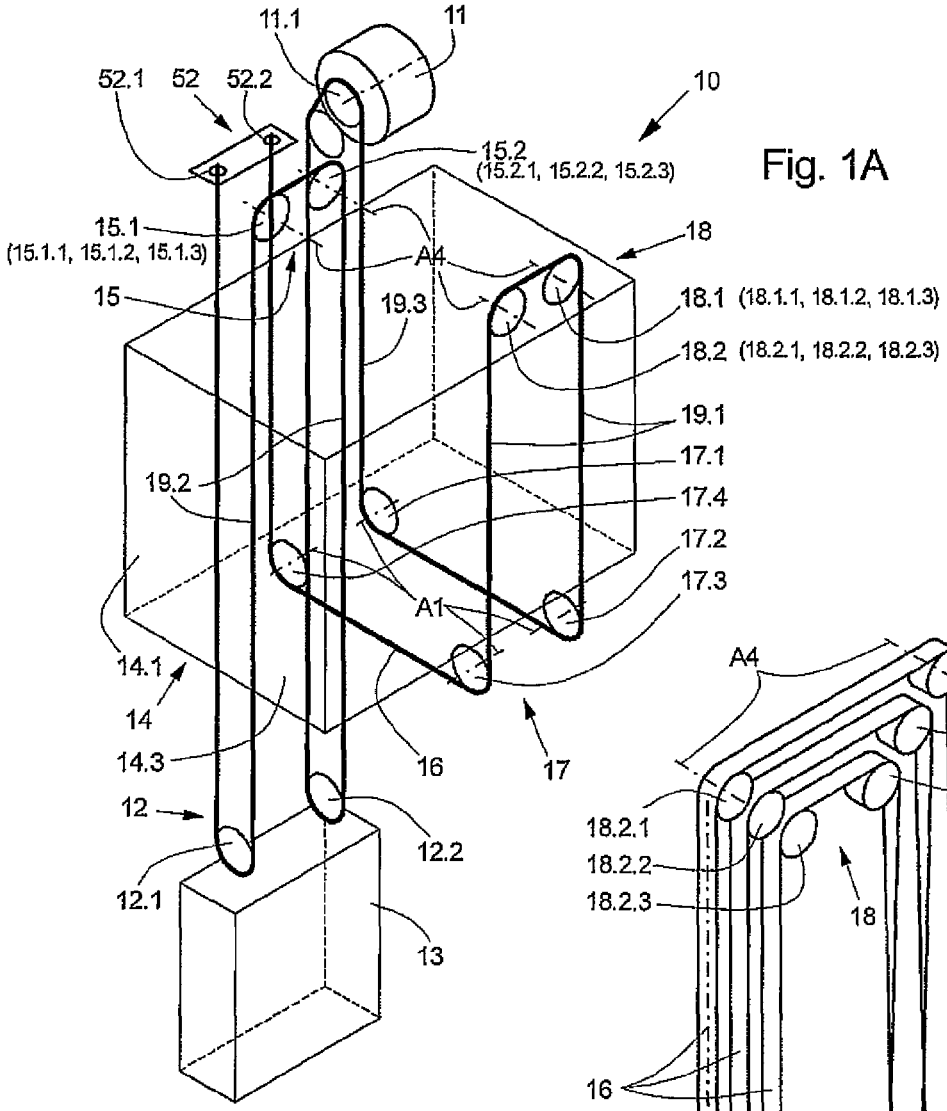
FIG. 1A is a schematic perspective view of a first arrangement of an elevator according to the present invention.
Figure 1B:
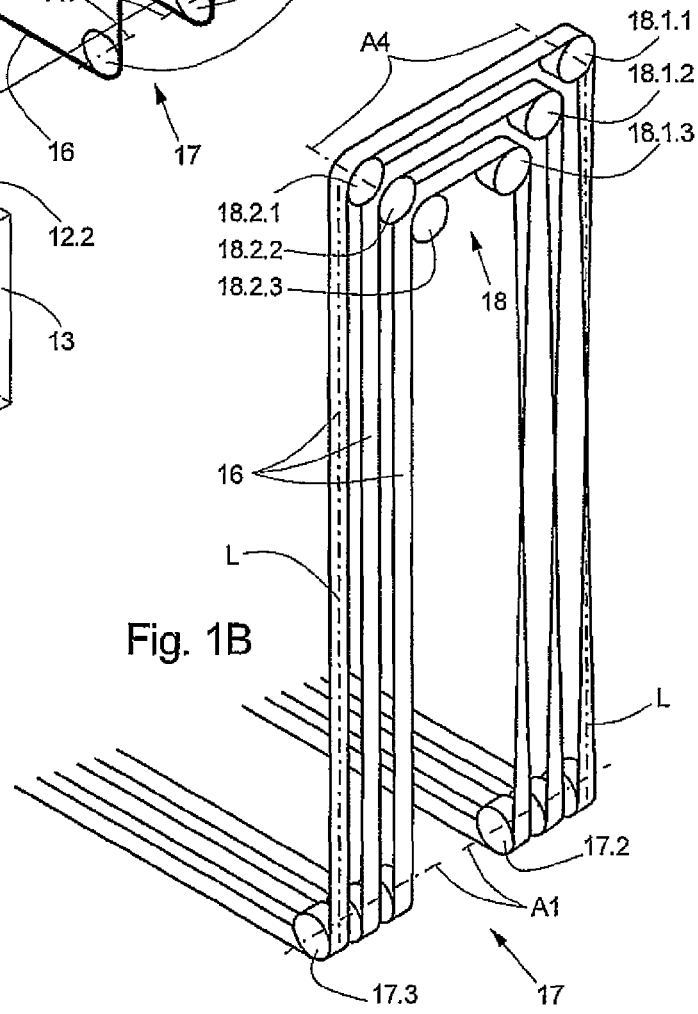
FIG. 1B is an enlarged detail of FIG. 1A with illustration of a support means roller arrangement.

FIG. 1A shows a support means arrangement for an elevator 10 with an elevator car 14 and a counterweight 13 according to a first form of embodiment of the present invention. For the purpose of better clarity, the support means strands, which comprise several belts 16, and the associated supporting and deflecting rollers are illustrated in each instance by a single line or a single circle. FIG. 1B shows, in an enlarged detail of FIG. 1A, the effective arrangement of the belts 16 and the supporting and deflecting rollers in a region which comprises a fixed (multi-axial) roller group 18 with the individual rollers 18.1.1-18.2.3 and two (coaxial) roller units 17.2, 17.3 of a movable—i.e. belonging to the elevator car 14—car roller group 17.

Present below the elevator floor 14.3 is a movable car roller group 17 which is connected with the floor and consists of four coaxial roller units 17.2, 17.4 and 17.2, 17.3. The axes A1 of rotation of the four coaxial roller units extend substantially parallel to one another. According to the present invention use can be made of at least "n" belts 16 extending substantially parallel to one another, wherein "n" is equal to or greater than two and is a whole number. These "n" belts 16 form a so-termed belt group. In the present example of embodiment the belt group comprises "n=3" belts. Each of the belts 16 extending parallel to one another is arranged as follows in the illustrated form of embodiment:

From a fixing point support 52 present above the floor level of the elevator car 14 disposed in highest position the belt 16 extends downwardly and loops around a first counterweight roller unit 12.1 of a movable counterweight roller group 12.

Subsequently it runs vertically upwardly along a first side 14.1 of the elevator car 14, wherein it rotates about its longitudinal center axis "L" and initially loops around a first individual roller 15.1 and then a second individual roller 15.2 of the first fixed (multi-axial) roller group 15.

It now extends vertically downwardly, wherein it undergoes a further rotation about its longitudinal center axis "L" and loops around a second counterweight roller unit 12.2 of the movable counterweight roller group 12.

It again runs vertically upwardly and loops around a drive pulley 11.1 of a drive unit 11.

From the drive pulley it is guided downwardly along the first side 14.1 of the elevator car 14 to a first (coaxial) roller unit 17.1 of the movable car roller group 17 and subsequently extends below the elevator floor 14.3 to the second (coaxial) roller unit 17.2 of the movable car roller group 17 and loops around this.

After looping around the roller unit 17.2 it again extends upwardly along the second side 14.2 of the elevator car 14, wherein it undergoes a further rotation about its longitudinal center axis "L" and loops around a first individual roller 18.1.1 and subsequently a second individual roller 18.1.2 of a second fixed (multiaxial) roller group 18.

From here it extends vertically downwardly along the second side 14.2 of the elevator car 14 to the third roller unit 17.3 of the movable car roller group 17, wherein it again undergoes a rotation about its longitudinal center axis "L".

It loops around the roller unit 17.3 and extends below the elevator floor 14.3 to the fourth roller unit 17.4 of the movable car roller group 17, whereafter it is led upwardly along the first side 14.1 of the elevator car 14 to the fixing point support 52 and fixed there at its second end.

The individual rollers 18.1.1-18.2.3 of the second fixed (multi-axial) roller group 18 as well as the individual rollers 15.1.1-15.2.3 of the first fixed (multi-axial) roller group 15 have axes A4 of rotation which are horizontally turned through approximately 90° relative to the axes A1 of rotation of the four coaxial roller units 17.1, 17.2. In the embodiment shown in FIG. 1 the rotational axes A4 of the rollers of the said fixed roller groups are also turned through 90° relative to the axes of the counterweight roller units 12.1, 12.2. All rotational axes A1 and A4 extend substantially parallel to the elevator floor 14.3.

As illustrated in FIG. 1B, each of the three belts 16 extending substantially parallel to one another is rotated through approximately 90° about its longitudinal center axis "L" in the region between the coaxial roller units 17.2, 17.3 of the movable car roller group 17 and the individual rollers 18.1.1-18.2.3 of the fixed roller group 18 (i.e. in the region 19.1, FIG. 1A). The "n" individual belts 16 of a belt group so extend, in the illustrated example of embodiment, along the elevator floor 14.3 that their belt main surfaces are guided parallel to the elevator floor. After the deflection about one of the coaxial roller units 17.2 or 17.3 the belt main surfaces initially extend parallel to a side wall 14.1 or 14.2 of the elevator car 14. Until running onto the individual rollers 18.1.1-18.3.2 of the fixed roller group 18 the "n" individual belts 16 have to be so rotated about their longitudinal center axes "L" that the belt main surfaces correctly impinge on the circumferential surfaces of the individual rollers 18.1.1-18.3.2 of the fixed roller group 18.

The statements made in the foregoing section generally relate to the arrangement of the belts between the rollers of the fixed roller groups 15, 18 and the rollers of the movable car roller groups 17, 12 connected with the elevator car 14 or the counterweight 13. They thus also apply to the regions 19.2, which are schematically illustrated on the side 14.1 of the elevator car 14, of the belt sections extending from the fixed (multi-axial) roller group 15 to the movable counterweight roller group 12.

Further details of the example of embodiment shown by way of example in FIGS. 1A and 1B are discussed in the following. Arranged at the left below the elevator car 14 is the counterweight 13, which moves in opposite direction to the elevator car 14. The counterweight 13 is carried by two coaxial counterweight roller units 12.1, 12.2 of a movable counterweight roller group 12, which are looped under by the "n+3" belts 16. A drive unit 11 with a drive pulley 11.1 is arranged in the upper region, for example at the head end of an elevator shaft (not shown). As illustrated in FIG. 1A, a second fixed roller group 15, which is preferably fixed in a region below the drive unit 11, is present. The "n=3" belts 16 run parallel to one another from the fixing point 52.1 to the first (coaxial) counterweight roller unit 12.1, loop around this and run upwardly to the rollers 15.1.1-15.2.3 of the fixed roller group 15, loop around this, extend downwardly to the second counterweight roller unit 12.2, loop around this, again run upwardly and around the drive pulley 11.1, run downwardly again and reach the roller units 17.1 of the movable car roller group 17. The "n=3" belts extending from the coaxial counterweight roller units 12.1 and 12.2 to the individual rollers 15.1.1-15.2.3 are rotated through approximately 90° about their longitudinal center axes in the regions 19.2.

The "n=3" belts can be rotated through approximately 180° about their longitudinal center axes in the region 19.3, which lies between the drive pulley 11.1 and the roller unit 17.1 of the movable car roller group 17, of the belts so as to make it possible for belts, which are structured—for example provided with ribs and grooves—on only one side, to contact by their structured side and not only the drive pulley 11.1, but also the roller unit 17.1. In the afore-mentioned region 19.2 the belts can, however, also be installed without rotating, for example if the belts are structured on both sides or if they have no structuring at all on their belt surfaces and are guided by other means.

Either or both of the fixed roller groups 15, 18 can be mounted at or on lateral guide rails of the elevator 10, wherein preferably special mounting means are provided which allow the arising forces to be introduced centrally (in the middle) into the guide rails.

Figure 2A:
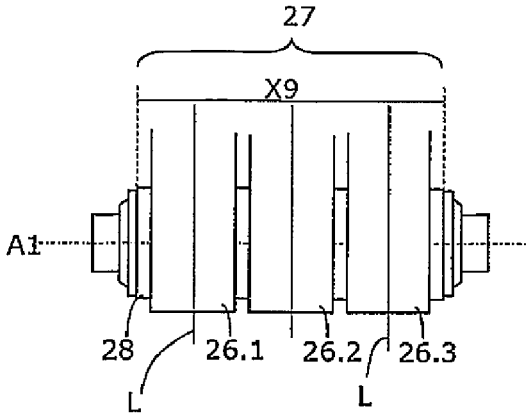
FIG. 2A is an elevation view of a first coaxial roller unit which can be used in an elevator according to the present invention.
Figure 2B:
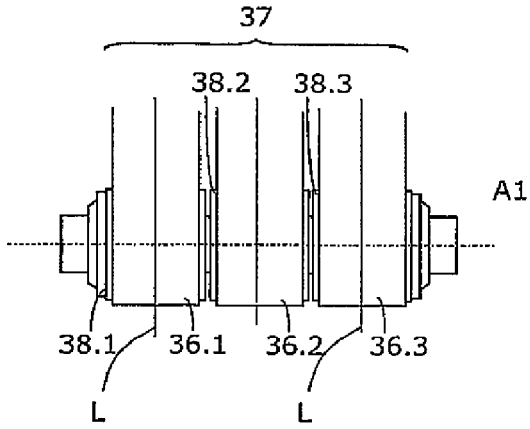
FIG. 2B is an elevation view of a second coaxial roller unit which can be used in an elevator according to the present invention.
Figure 5A:
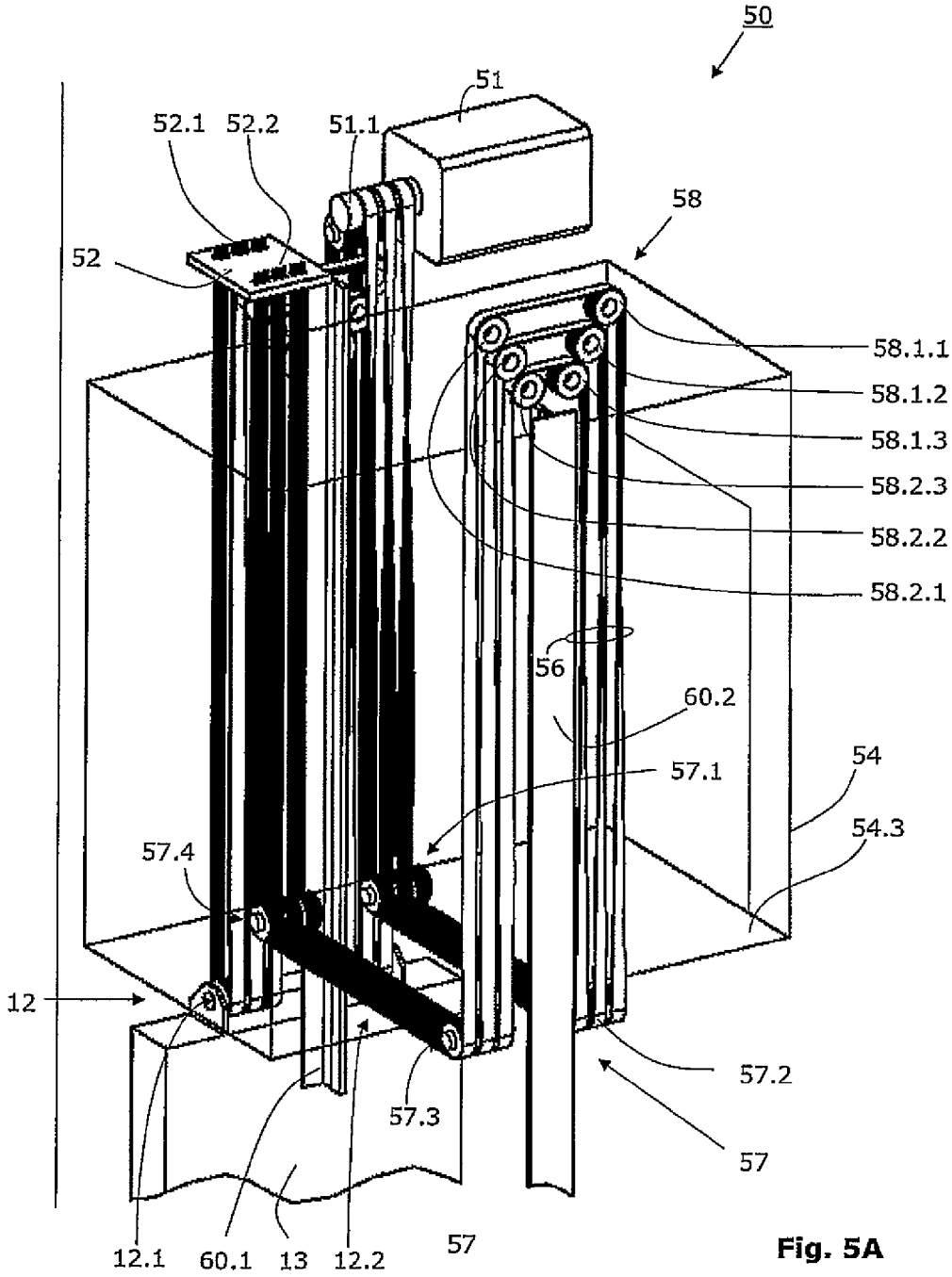
FIG. 5A is a schematic perspective view of a further arrangement according to the present invention.
Figure 6:
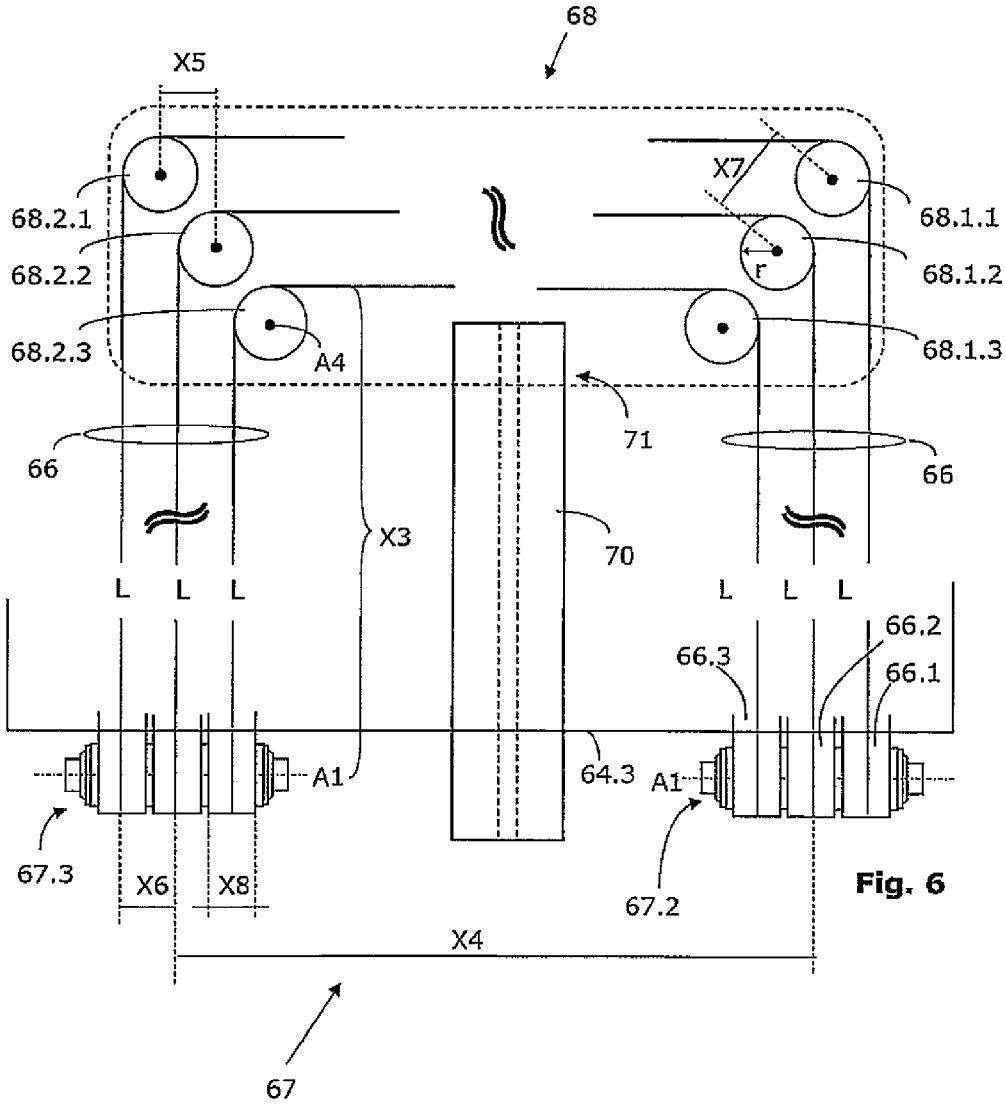
FIG. 6 is a schematic partial view of a further arrangement according to the present invention.
Figure 7:
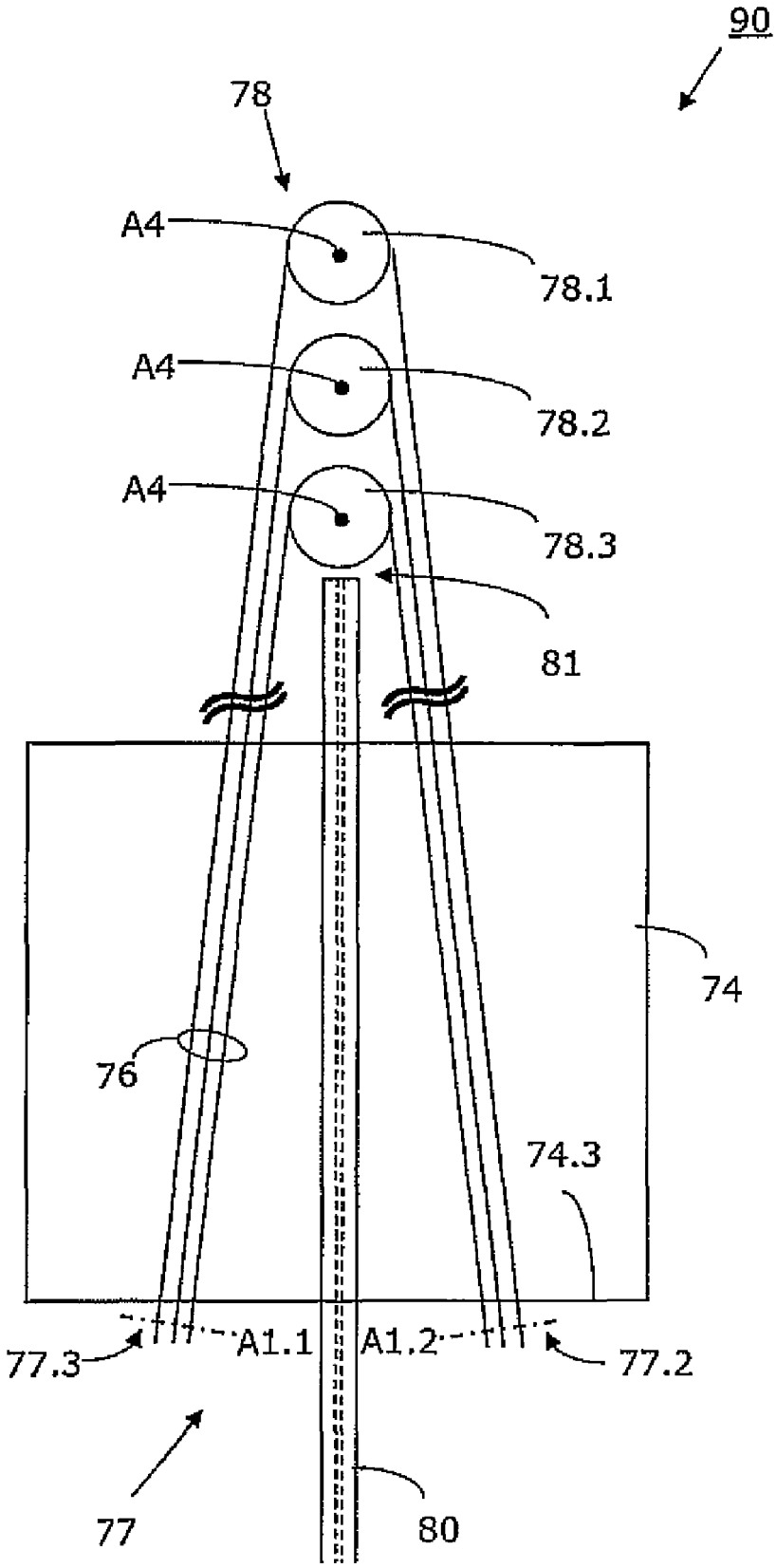
FIG. 7 is a schematic partial view of a further arrangement according to the present invention.

By a "coaxial movable roller unit" there is to be understood in the present connection a roller arrangement which is mounted at an elevator car or a counterweight and which can deflect "n≧2" belts lying adjacent to one another. As explained by way of example on the basis of FIGS. 2A and 2B, a coaxial roller unit 27 or 37 has for this purpose a cylindrical casing 28 or 38.1, 38.2, 38.3 against which the belt main surfaces 26.1-26.3 or 36.1-36.3 bear when deflected. A coaxial roller unit 27 can have, for example and as shown in FIG. 2A, a single cylindrical circumference 28 with an axis A1, wherein the cylinder length X9 is so selected that all "n=3" belts 26.1-26.3 of a group can circulate adjacent to one another without coming into mutual contact. Since all "n =3" belts 26.1-26.3 have the same speed of circulation it is not necessary to separate the cylindrical circumference 28 into individual cylinder discs. However, it is also conceivable, as shown in FIG. 2B, for a coaxial roller unit 37 to consist of a number of individual coaxial cylinder discs 38.1, 38.2, 38.3 arranged adjacent to one another on a common axis "A1". The coaxial roller units of the movable car roller group 17 can up 17 can either be so arranged that their axes A1 extend parallel to the elevator floor, as indicated in FIGS. 1A, 5A and 6, or their axes A1.1, A1.2 can be slightly inclined with respect to the elevator floor, as indicated in FIG. 7.

The expression "(co-axial) roller unit of a movable roller group" was selected to emphasize the distinction in relation to the arrangement of the individual rollers of the (multi-axial) fixed roller groups 15, 18. The rollers of the (multi-axial) fixed roller groups 15, 18 are mounted individually, i.e. each of the rollers of a fixed roller group has an own axis of rotation. The end surfaces of the individual rollers lie substantially in one plane and all roller axes extend parallel to one another and perpendicularly to the said plane. The individual rollers 15.1.1-15.2.3, 18.1.1-18.2.3 of the multi-axial fixed roller groups 15, 18 are arranged either directly one above the other or obliquely one above the other (cascaded) in the mounted state. Further details of a multi-axial fixed roller group with cascaded rollers are described, by way of example, with reference to FIG. 6 and details of a multi-axial fixed roller group with rollers lying vertically one above the other are described, by way of example, with reference to FIG. 7.

As belts use is preferably made of belts having a belt main surface which is structured so as to ensure guidance of the belt on the rollers or to improve the traction capability. The structured belt main surface can, for example, have ribs and grooves extending in longitudinal direction of the belt. The invention can, however, also be realized by non-structured belts.

If use is made of belts with a structured surface, then the circumferential surfaces of the drive pulley and at least some of the supporting and deflecting rollers are preferably similarly structured so as to ensure guidance of the belt on the rollers or to improve the traction capability between drive pulley and the belt. The circumferential surfaces of the drive pulleys and the rollers preferably have, as structuring, ribs and grooves which are executed to be complementary to those of the belt. The ribs and grooves in that case extend in the circumferential direction of the circumferential surface of the drive pulley and the rollers.

As described in connection with FIG. 1A, the rotational axes of the roller units of the movable roller groups and the rotational axes of the rollers of the fixed roller groups are disposed at an angle of approximately 90° relative to one another. Belt sections arranged between rollers of the movable roller groups and rollers of the fixed roller groups therefore usually experience a 90° rotation about their longitudinal axis, wherein the direction of rotation is preferably so selected that the same belt main surface always comes into engagement with the circumferential surfaces of the various rollers.

Figure 3:
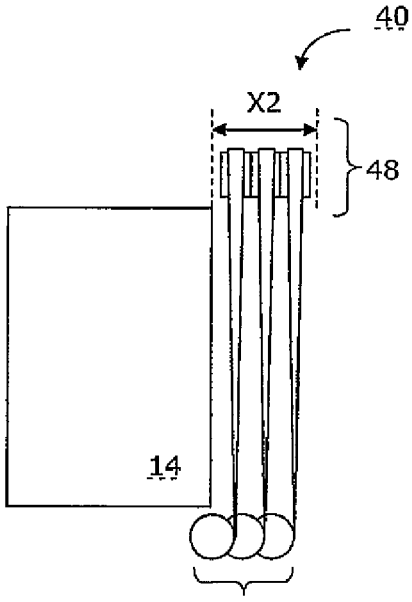
FIG. 3 is a schematic of a possible further arrangement according to the present invention.

An advantage of the present invention is immediately obvious when the partial view of an elevator 40, which is schematically illustrated in FIG. 3, is considered. There it is illustrated that the individual elements of a (movable) car roller group 47, which are part of the under-looping, have to be displaced relative to one another in order to be able to deflect the "n=3" individual belts of a group about a fixed roller arrangement 48 with a common axis. Substantially more space laterally adjacent to the elevator car 14 would be needed for this fixed roller arrangement 48 with a common axis than in the case of an arrangement according to the present invention, since the width X2 of the roller arrangement 48 is substantially greater than the width of the fixed roller groups 15, 18 (FIGS. 1A, 1B) in which the individual rollers—and the belt—are arranged one above the other.

The individual rollers of the fixed roller groups are preferably arranged to be cascaded (staggered one above the other), as shown by way of example in FIG. 6. Through the cascaded arrangement of the individual rollers of the fixed roller groups and through the use of individual roller axes, it is possible to achieve a compact form of construction which can find space without problems alongside or above the elevator car, as can be seen, for example, by way of FIGS. 1A, 1B and 5A.

Figure 4:
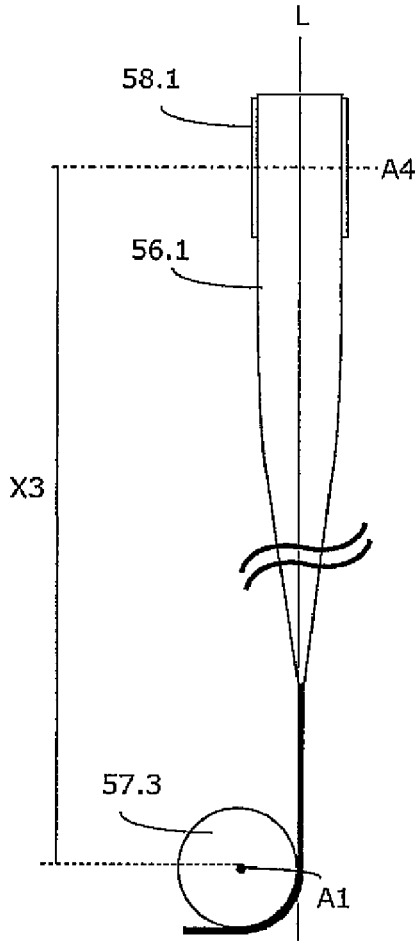
FIG. 4 is a schematic partial view of a further arrangement according to the present invention.

It is important that the rollers of the movable roller groups and the rollers of the fixed roller groups are arranged relative to one another in a specific physical relationship so as to ensure that the belts do not have to run at an angle from one roller to the other. The transition of a belt from a roller unit 57.3 of a movable car roller group 57 to a roller 58.1 of a multi-axial fixed roller group 58 is shown in FIG. 4 in substantially simplified form. The longitudinal center axis L of the belt 56.1 extends approximately tangentially to the circumferential surfaces of the rollers 57.3 and 58.1. It is a precondition for faultless transition of the belt from the roller unit 57.3 to the roller 58.1 arranged at right angles thereto that the two rollers are so oriented relative to one another that a common tangent emanating from the respective roller centers is present. It is also important that for rotation of the belt about the longitudinal center axis L sufficient spacing X3 between the axes of the participating rollers is present. This spacing X3 should be at least twenty times the belt width for a 90° rotation and at least forty times the belt width for a 180° rotation (see FIG. 4 and FIG. 6).

Figure 5B:
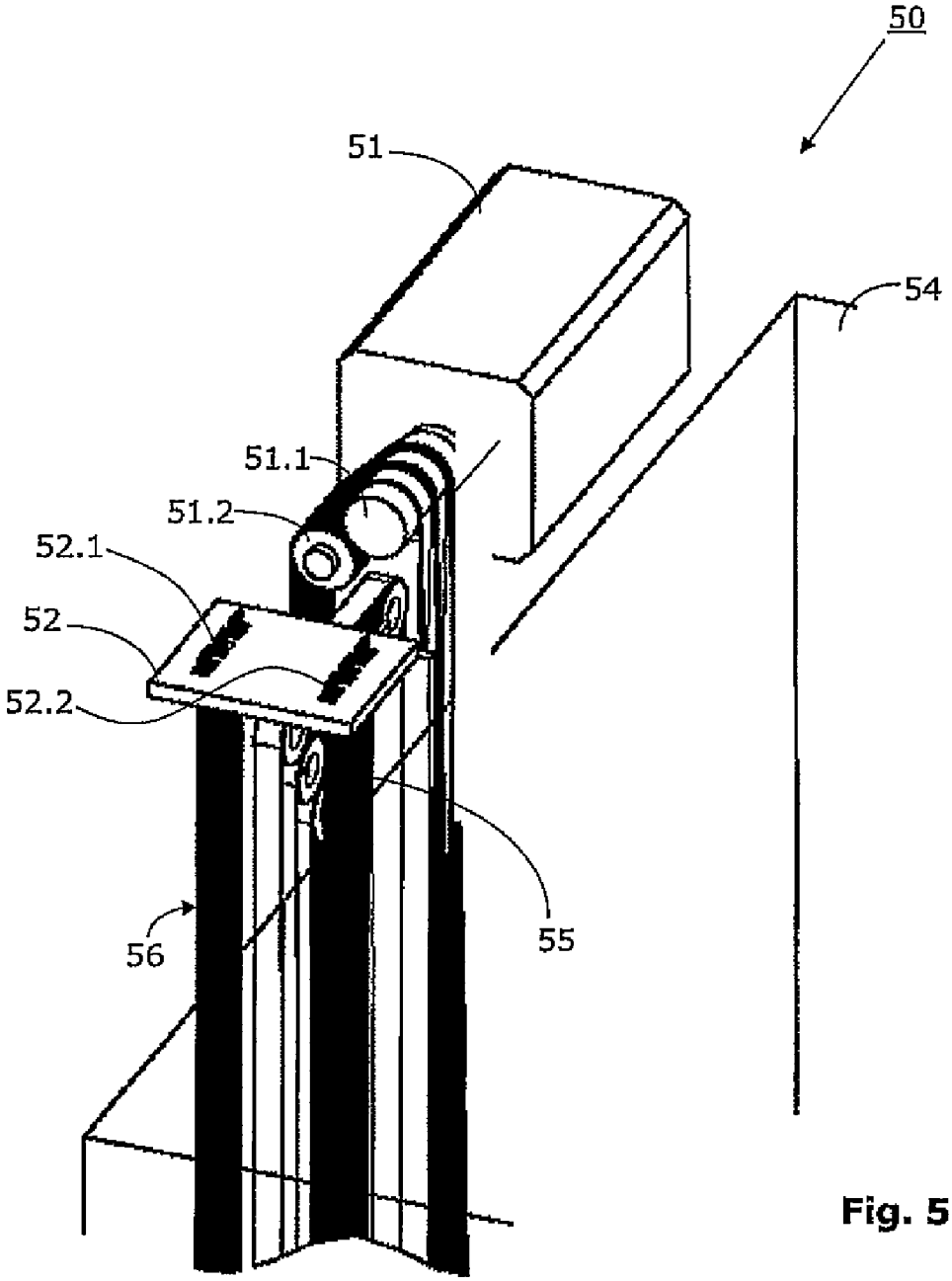
FIG. 5B is an enlarged partial view of the arrangement according to FIG. 5A.

Further details can be inferred from FIGS. 5A and 5B, which illustrate an elevator according to the present invention in somewhat more detail. They show a detail of an upper shaft region of an elevator 50. The elevator car 54 is indicated only schematically. A drive motor 51 arranged in the upper shaft region can be seen. The drive motor 51 has a drive axle with a drive pulley 51.1. A fixing point support 52 for fastening the "n=3" belts of the belt group 56 is arranged in the same shaft region. In the illustrated example of embodiment all ends of the belts of the belt group 56 are fastened to the same fixing point support 52. This fixing point support 52 can be fastened to the shaft wall or to a guide rail 60.1 of the elevator 50. In the illustrated example of embodiment the multi-axial fixed roller group 55 is seated, as can be seen in FIG. 5B, below the drive motor 51 in the region of a rearward shaft wall of the elevator shaft. In order to create sufficient space for the multi-axial fixed roller group 55 a deflecting roller 51.2, which guides the belts 56 coming from below to the drive pulley 51.1, is arranged laterally below the drive pulley 51.1 (see also FIG. 5B).

The path of the belts of the belt group 56 is described in the following with reference to FIGS. 5A and 5B. Use is also made in the present example of embodiment of "n=3" parallel belts, but the invention can also be realized, as already emphasized elsewhere, with less than three or more than three belts. The belts 56 are guided from the fixing point 52.1 of a fixing point support 52 as follows:

Downwardly parallel to a side wall of the elevator shaft and around a first counterweight roller unit 12.1 of a movable counterweight roller group 12;

Upwardly from there parallel to the side wall of the elevator shaft, wherein each belt of the belt group 56 makes a 90° turn about its longitudinal center axis L in order to then be guided around two associated individual rollers of the first (multi-axial) fixed roller group 55;

From the first fixed roller group 55 the belts of the belt group 56 run downwardly parallel to the side wall of the elevator shaft and after a further rotation about their longitudinal center axes L around a second counterweight roller unit 12.2 (partly covered in FIG. 5A);

After looping round the second counterweight roller unit 12.2 the belts of the belt group 56 run upwardly parallel to the side wall of the elevator shaft and loop around a deflecting roller 51.2 and a drive pulley 51.1 of a drive motor 51;

From there the belts of the belt group 56 again run downwardly parallel to the side wall of the elevator shaft to the first coaxial roller unit 57.1 of a movable car roller group 57 present in the lower region of the elevator car 54;

There the belts of the roller group 56 are deflected in common and run parallel to the elevator floor 54 below the elevator car 54 to the second coaxial roller unit 57.2 of the movable car roller group 57;

There the belts of the belt group 56 are deflected and run upwardly between a side wall of the elevator car and a side wall of the elevator shaft, and with execution of a further rotation about their respective longitudinal center axes L, to the individual rollers of the second multi-axial fixed roller group 58, which in the illustrated example of embodiment is similarly arranged in the upper shaft region;

Within the multi-axial roller arrangement 58 each of the belts runs from a first roller 58.1.1, 58.1.2, 58.1.3 associated therewith to a second roller 58.2.1, 58.2.2, 58.2.3 associated therewith;

From there the belts of the belt group 56 run downwardly along the side wall of the elevator car, with execution of a further rotation about their respective longitudinal center axes L, to a third coaxial roller unit 57.3 of the movable car roller group 57;

There the belts of the belt group 56 are deflected and run parallel to the elevator floor of the elevator car 54 to the fourth coaxial roller unit 57.4; and then along the second side wall of the elevator car with respect to the side wall of the elevator shaft up to a second fixing point 52.2, which in the present case lies, together with the first fixing point 52.1, on a fixing point support 52.

Further details of a possible support means arrangement are illustrated in FIG. 6 in the form of a schematic partial view. A region of the elevator system with an elevator car, the elevator floor 64.3 of which is indicated in FIG. 6, is illustrated. Four coaxial roller units are arranged below the elevator floor 64.3 at this, of which only the roller units 67.2 and 67.3 are visible in FIG. 6. The axes A1 of rotation of the four coaxial roller units extend substantially parallel to one another and lie parallel to the elevator floor 64.3. The elevator also has in this example of embodiment "n=3" substantially mutually parallelly extending belts 66 which are led at the right upwardly and at the left downwardly during the downward travel in the illustrated support means arrangement lying on the side of the elevator car denoted in FIG. 1 by 14.2. The coaxial roller unit 67.2 of the movable car roller group 67 deflects the belts 66 upwardly after they have run horizontally below the elevator floor 64.3. In the region denoted by X3 the three belts of the belt group 66 are rotated through 90° about their respective longitudinal center axes L and then run around the rollers 68.1.1, 68.1.2 and 68.1.3 of a multi-axial fixed roller group 68, as shown in FIG. 6. The first belt 66.1 of the belt group 66 is led around the rollers 68.1.1 and 68.2.1, the second belt 66.2 around the rollers 68.1.2 and 68.2.2 and the third belt 66.3 around the rollers 68.1.3 and 68.2.3, as illustrated in FIG. 6. The belts 66.1-66.3 are then led downwardly again at the side of the elevator car and in that case once more rotated about their respective longitudinal center axes L before they are deflected by a roller unit 67.3 in order to then run below the elevator floor 64.3 to a further roller unit.

The individual rollers 68.1.1-68.2.3 of the multi-axial fixed roller group 68 have rotational axes A4 which are turned through approximately 90° about a vertical axis relative to the rotational axes Al of the roller units 67.2, 67.3. These axes A4 can all be mounted in a common plate, which serves as mounting means, or a frame, which makes it possible to fasten the entire multi-axial fixed roller group 68 to a vertical guide rail 70 of the elevator. The mounting means can also be designed for fastening the fixed roller group 68 to a wall of the elevator shaft. The fastening of the mounting means can be carried out in a region 71 by means of screws or other fastening means.

The fastening of the fixed roller groups is preferably carried out in accordance with the present invention in such a manner that in each instance "n" rollers of the roller arrangement 68 are disposed on each side of the guide rail 70 so as to avoid torques (bending moments) acting on the guide rails in the case of loading of the belts.

Further details of a possible form of embodiment are illustrated in FIG. 7 in the form of a schematic part view. A region of an elevator system 90 with an elevator car 74 and an elevator floor 74.3 is shown. Four coaxial roller units are arranged below the elevator floor 74.3, of which only the roller units 77.2 and 77.3 are visible in FIG. 7. The rotational axes A1.1 and A1.2 of the four coaxial roller units can lie at an angle relative to one another and extend at an inclination relative to the plane of the elevator floor 74.3, wherein the roller units can either be fixed in the inclined position or be pivotably fastened to the car floor in such a manner that they are positioned by the belt tension in correspondence with the instantaneous direction of the obliquely extending belt sections.

The elevator also has in this example of embodiment "n=3" belts 76 which extend substantially parallel to one another and which are guided on the right obliquely upwardly and on the left obliquely downwardly at the illustrated side of the elevator car during downward travel. For the sake of simplicity only the belt longitudinal axes are indicated in FIG. 7. The coaxial roller unit 77.2 deflects the belts 76 upwardly after they have run horizontally below the elevator floor 74.3. Laterally of the elevator car the three belts of the belt group 76 are rotated about their respective longitudinal center axes L through 90° and then run around the rollers 78.1, 78.2 and 78.3 of a multi-axial fixed roller group 78, as shown in FIG. 7. The first belt of the belt group 76 is led around the roller 78.1, the second belt around the roller 78.2 and the third belt around the roller 78.3, as illustrated in FIG. 7. The belts loop around the rollers 78.1-78.3 by more than 90°. The belts 76 are then again led obliquely downwardly at the side of the elevator car and once more rotated about their respective longitudinal center axis L before they are deflected by a roller unit 77.3 in order to then run below the elevator floor 74.3 to a further roller unit. A guide rail 80 at or on the upper region 81 of which the fixed roller group 78 can be fastened is also indicated in FIG. 7. The rollers 78.1-78.3 are illustrated in FIG. 7 to enlarged scale.

The fastening of the fixed roller group according to the present invention is preferably carried out in such a manner that all "n" rollers of the roller group 78 are disposed in a line above the guide rail 80 so as to avoid torques (bending moments) acting on the guide rail 80 in the case of loading of the belts.

The fixed roller groups 68 or 78 according to the present invention are suitable for use in an elevator system with an elevator car which is looped under at least twice by "n" belts. Examples show a 4:1 suspension (reeving) with double under-looping. The fixed roller groups 68, 78 have "n" or "2n" individual rollers 78.1-78.3, or 68.1.1-68.2.3, as shown in, for example, FIG. 7 and FIG. 6. Each of the individual rollers 78.1-78.3, 68.1.1-68.2.3 is rotatably mounted on an own axis A4 of rotation, wherein the rotational axes A4 extend substantially parallel to one another. The rollers 68.1.1-68.2.3 are, according to the invention, arranged one above the other in cascaded (stepped) manner and the rollers 78.1-78.3 are, according to the invention, arranged directly one above the other. Preferably mounting means are present in order to be able to mount the entire fixed roller group 68 or 78 at or on a guide rail 70 or 80 of the elevator system.

The "2n" rollers of the fixed roller group are preferably subdivided in the cascaded form of embodiment into two groups each of "n" rollers, wherein the rollers of each of the groups are arranged staggered one above the other and the horizontal axial spacing X5 of two adjacent rollers is greater than the width X8 of the belt, as shown in FIG. 6. The radial axial spacing X7 is at least "2r+d", wherein "r" is the radius of the rollers and "d" the thickness of the belts.

The two groups of rollers are arranged at a spacing X4 which substantially corresponds with the spacing of the under-loopings of the elevator car, as shown in FIG. 6.

The mounting means are preferably so designed that in the mounted state a central introduction of force into the guide rails 70 or 80 takes place.

In a further form of embodiment according to the present invention (not illustrated) use can be made of a drive motor 51 with a drive pulley 51.1, the axis of which is arranged in the same plane as the axis of the drive pulley 51.1, which is shown in FIG. 5A, of the drive motor 51, but is turned relative to this axis through 90° about a vertical axis. In this case the axis of the drive pulley 51.1 extends parallel to the axes A4 of the fixed roller group 55, 58.

According to a further form of embodiment (not shown) the axes of the counterweight roller units supporting the counterweight are turned relative to the counterweight roller units 12.1, 12.2, which are illustrated in FIG. 1A, through 90° about a vertical axis so that the belts do not have to be rotated in the regions denoted by 19.2 (FIG. 1A). However, a rotation of the belts is required in this case between the second counterweight roller unit and the drive pulley 11.1—possibly the deflecting roller 51.2 in FIG. 5B—or, if the drive motor—as described in the foregoing section—is turned through 90°, in the region 19.3 between the drive pulley 11.1 and the car roller unit 17.1.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator with an elevator car and a supporting means forming a 4:1 suspension for the elevator car, wherein the supporting means loops under the elevator car several times, comprising:

at least two flat belts arranged parallel to one another included in said supporting means; and a plurality of rollers of at least one fixed roller group deflecting said at least two belts and so arranged that in a region of the belt deflection, at least two belt sections belonging to different ones of said at least two belts are arranged parallel to one another and are disposed one above another in a common vertical plane.

2. The elevator according to claim 1 wherein said at least one fixed roller group, which deflects said at least two belts, has an associated roller for each of said at least two belts, wherein each of said at least two belts loops around an associated one of said rollers by more than 90°.

3. The elevator according to claim 2 including a plurality of rollers of movable roller groups arranged along an axis that is disposed at an inclination or is movable to an inclination relative to an axis of rotation of said roller of said at least one fixed roller group.

4. The elevator according to claim 1 wherein said at least one fixed roller group, which deflects said at least two belts, has two associated rollers for each of said at least two belts.

5. The elevator according to claim 4 wherein subgroups of rollers of said at least one fixed roller group are arranged slanted one above the another, wherein a horizontal axial spacing greater than a width of each of said at least two belts is present between two adjacent ones of said rollers arranged one above another.

6. The elevator according to claim 1 wherein at least two fixed roller groups including said at least one fixed roller group are arranged at least one of laterally of and above the elevator car.

7. The elevator according to claim 6 wherein said at least two fixed roller groups are fastened to or on one or more guide rails of the elevator system.

8. The elevator according to claim 1 wherein said rollers of said at least one fixed roller group lie within two parallel planes spaced apart by a width of one of said rollers, wherein axes of said rollers are oriented at right angles to the planes.

9. The elevator according to claim 1 wherein each of said at least two belts is fixed at two ends thereof to a fixing point, wherein all fixing points of said at least two belts are arranged directly adjacent or on a fixing point support connected with a guide rail.

10. The elevator according to claim 1 wherein said at least two belts are provided at at least one main surface thereof with ribs and grooves extending In a belt longitudinal direction and a drive pulley and said rollers of said at least one fixed roller group have corresponding complementary ribs and grooves along a circumference of running surfaces.

11. The elevator according to claim 1 wherein said at least two belts are provided at at least one main surface thereof with ribs and grooves extending in a belt longitudinal direction and a drive pulley and rollers of at least one movable roller group have corresponding complementary ribs and grooves along a circumference of running surfaces.

12. A roller arrangement for use in an elevator with a supporting means forming a 4:1 suspension of an elevator car looped under several times, wherein said supporting means comprises at least two flat belts arranged parallel to one another, comprising:

a plurality of fixed roller groups and movable roller groups that deflect the belts, the belts being arranged parallel to one another, wherein said rollers of at least one of said fixed roller groups deflect the belts and are arranged so that in a region of the belt deflection, at least two belt sections belonging to different ones of the belts are arranged parallel to one another and are disposed one above another in a common vertical plane.

* * * * *